US006805589B2

(12) United States Patent
Lee

(10) Patent No.: US 6,805,589 B2
(45) Date of Patent: Oct. 19, 2004

(54) MEMORY CARD SOCKET WITH DRAWER-TYPE CARTRIDGE SEAT

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 10/366,572

(22) Filed: Feb. 14, 2003

(65) Prior Publication Data

US 2004/0161976 A1 Aug. 19, 2004

(51) Int. Cl.[7] ..... H01R 24/00
(52) U.S. Cl. ..... 439/630; 439/945; 439/638
(58) Field of Search ..... 439/630, 638, 439/945, 946; 361/680, 751, 737, 752, 395, 684; 369/75.1, 75.2

(56) References Cited

U.S. PATENT DOCUMENTS 5,862,116 A * 1/1999 Watanabe et al. ..... 369/75.2
5,966,972 A * 10/1999 Chuang ..... 70/456
6,264,506 B1 * 7/2001 Yasufuku et al. ..... 439/638

* cited by examiner

*Primary Examiner*—Alex Gilman
(74) *Attorney, Agent, or Firm*—Rosenberg, Klein & Lee

(57) ABSTRACT

A memory card socket with drawer-type cartridge seat, including a seat body and a cartridge seat. The seat body includes a bottom board section and a top board section which define therebetween a slide cavity. Multiple terminals are inlaid in the seat body. The cartridge seat includes a board body snugly sidably placed in the slide cavity of the seat body. At least one memory card chamber is formed on the board body, whereby a memory card can be stably overlaid on and received in the memory chamber. A front board is connected with front edge of the board body, whereby when the board body is slidably placed in the seat body, the front board totally blocks an entry of the slide cavity of the seat body, so that external alien articles or dust is prevented from entering the seat body through the entry.

5 Claims, 7 Drawing Sheets

MEMORY CARD SOCKET WITH DRAWER-TYPE CARTRIDGE SEAT

BACKGROUND OF THE INVENTION

1. Field of the Invention

The present invention is related to a memory card socket with drawer-type cartridge seat, and more particularly to a memory card signal adapting socket applied to digital camera.

2. Description of the Prior Art

FIGS. 6 and 7 show a conventional memory card connector including a board-type base seat 10 and base boards 20, 30 fixed on upper and lower faces of the base seat 10. The base seat 10 horizontally extends from a memory card insertion end to the other end. The base seat 10 is formed with multiple memory card chambers 16, 17, 18 overlapping each other for receiving different sizes and types of memory cards. After the base seat 10 is assembled with the two base boards 20, 30, the memory card chambers 16, 17, 18 are defined on the base seat 10 for receiving different types of memory cards. Accordingly, different types of memory cards can be inserted into the adapter for data transmission.

In the above memory card signal adapting socket, the base seat 10 is sandwiched between the two base boards 20, 30 and cannot be drawn out. The entry of the memory card chamber 16, 17, 18 defined between the front end of the base seat 10 and the base boards 20, 30 is always open without any shielding measure. As a result, external alien articles or dust can easily enter the signal adapting socket through the entry and accumulate therein. This leads to poor contact between the internal connecting terminals and the inserted memory card.

SUMMARY OF THE INVENTION

It is therefore a primary object of the present invention to provide a memory card socket with drawer-type cartridge seat, including a seat body and a cartridge seat. The seat body includes a bottom board section and a top board section which define therebetween a slide cavity. Multiple terminals are inlaid in the seat body. The cartridge seat includes a board body snugly slidably placed in the slide cavity of the seat body. At least one memory card chamber is formed on the board body, whereby a memory card can be stably overlaid on and received in the memory chamber. A front board is connected with front edge of the board body, whereby when the board body is slidably placed in the seat body, the front board totally blocks an entry of the slide cavity of the seat body, so that external alien articles or dust is prevented from entering the seat body through the entry.

The present invention can be best understood through the following description and accompanying drawings wherein:

BRIEF DESCRIPTION OF THE DRAWINGS

FIG. 4 is a perspective view of the present invention, showing that the cartridge seat is pushed in;

DETAILED DESCRIPTION OF THE PREFERRED EMBODIMENTS

Figure 1:
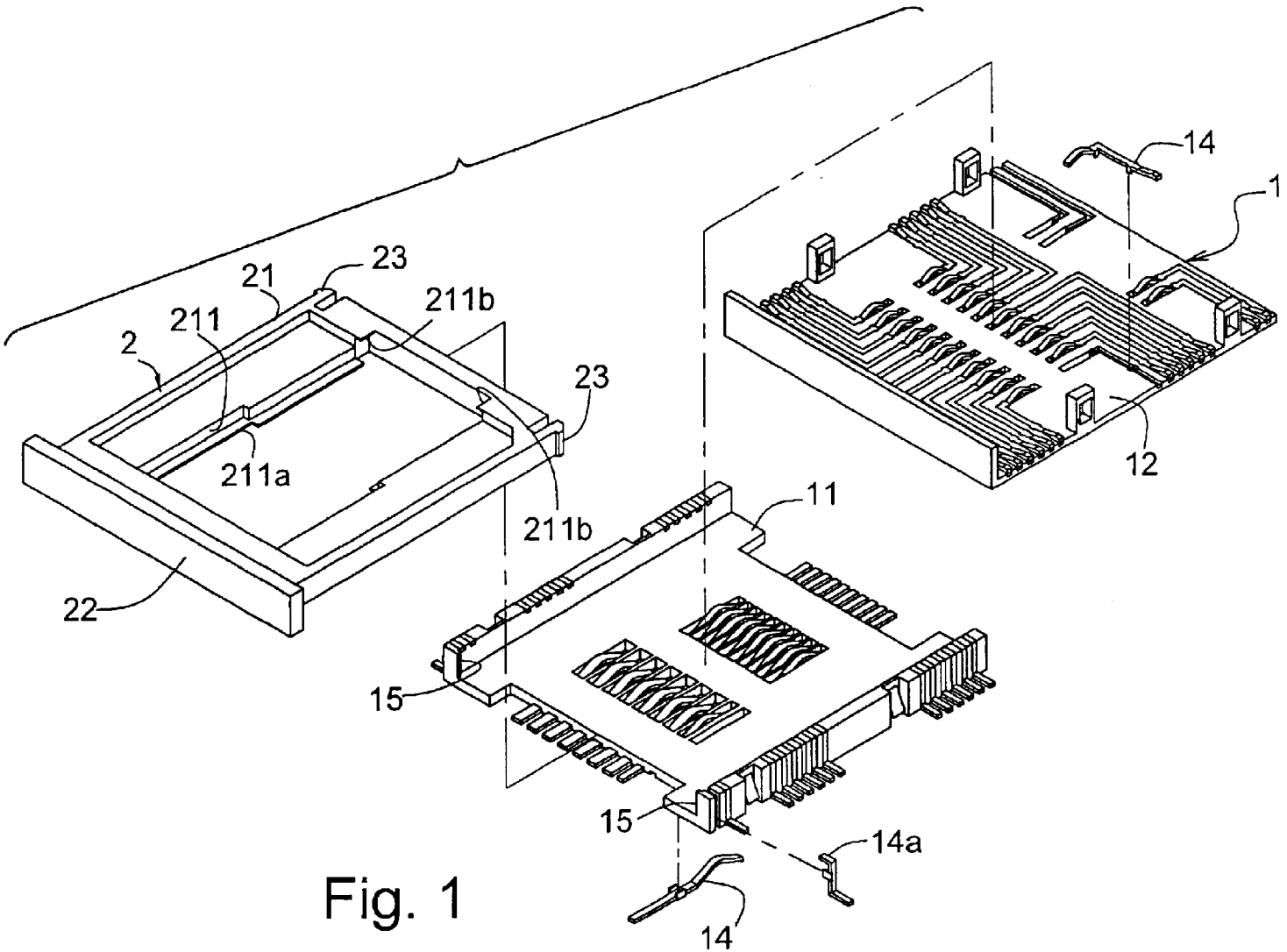
FIG. 1 is a perspective exploded view of the present invention.

Please refer to FIGS. 1 to 5. The memory card socket with drawer-type cartridge seat of the present invention includes a seat body 1 and a cartridge seat 2. The seat body 1 includes a bottom board section 11 and a top board section 12 which define therebetween a slide cavity 13. Multiple terminals 14 are inlaid in the seat body 1. The cartridge seat 2 includes a board body 21 snugly slidably placed in the slide cavity 13 of the seat body 1. At least one memory card chamber 211 is formed on the board body 21, whereby a memory card can be stably overlaid on and received in the memory chamber 211. A front board 22 is connected with front edge of the board body 21. When the board body is sidably placed in the seat body 1, the front board 22 totally blocks the entry 130 of the slide cavity of the seat body 1. Accordingly, external alien articles or dust is prevented from entering the seat body through the entry 130.

The seat body 1 can be made of a plastic material or composed of multiple boards overlapping each other. Referring to FIG. 1, the seat body 1 includes: a bottom board section 11 overlaid on a circuit board 3, multiple terminals 14 being inlaid in the bottom board section 11, one end of the terminal 14 being soldered with a corresponding circuit of the circuit board 3; a top board section 12 correspondingly overlaid on and latched with the bottom board section 11, multiple terminals 14 being inlaid in the top board section 12; and multiple connecting terminals 14*a* stably inlaid in the bottom board section 11. One end of the connecting terminal 14*a* is soldered with a corresponding circuit of the circuit board 3, while the other end thereof projectively extends to lower side of a second end of the corresponding terminal 14 of the top board section 12. Accordingly, after the bottom board section 11 and the top board section 12 are mated with each other, the terminals 14 of the top board section 12 respectively correspondingly contact with the connecting terminals 14*a* to electrically connect with the circuit of the circuit board 3.

The bottom board section 11 and the top board section 12 can be taken from printed circuit board and the terminals 14 are directly soldered on the bottom board section 11 and the top board section 12. The electric connection measure of the seat body 1 is not limited.

In a modification of the above embodiment, the terminals 14 are only inlaid in the bottom board section 11 or the top board section 12.

At least one memory card chamber 211 is formed on the board body 21 of the cartridge seat 2. The memory card chamber 211 has at least one lower stop edge 211*a* projecting therefrom for supporting a memory card, whereby a memory card can be stably overlaid on and received in the memory chamber 211. The memory card can enter the seat body 1 along with the cartridge seat 2 to connect with the terminals 14 thereof.

At least one side of the memory card chamber 211 has an upper stop edge 211*b* projecting therefrom for abutting against upper side of the received memory card, whereby the memory card is prevented from upward jumping and displacing.

Figure 2:
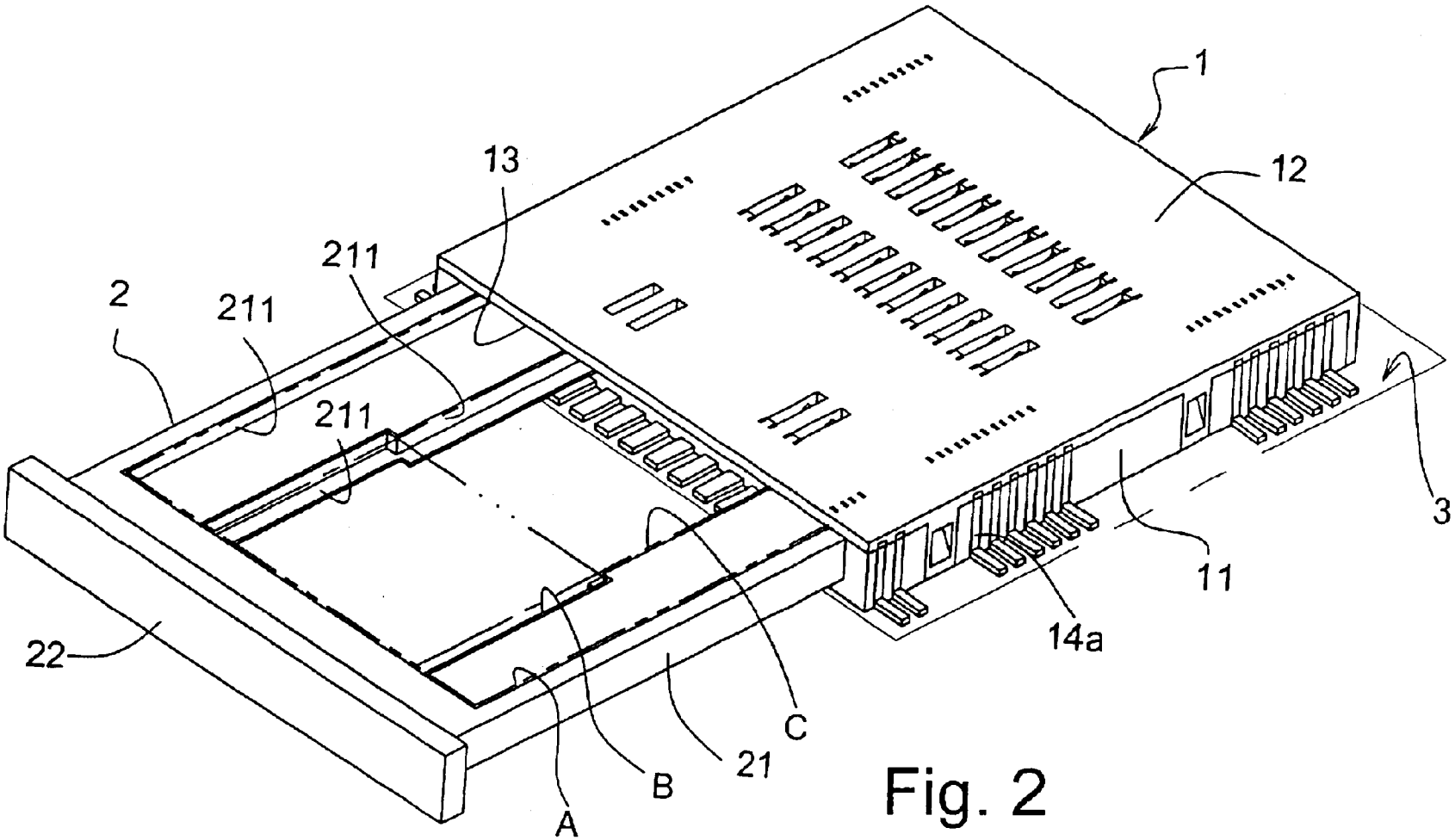
FIG. 2 is a perspective view of the present invention, showing that the cartridge seat is drawn out.

As shown in FIG. 2, the board body 21 of the cartridge seat 2 can be formed with multiple types of memory card chambers A, B, C overlapping each other. These memory card chambers A, B, C meet the specifications of three existent different types of memory cards. However, the number and types of the memory card chambers are not limited.

Figure 3:
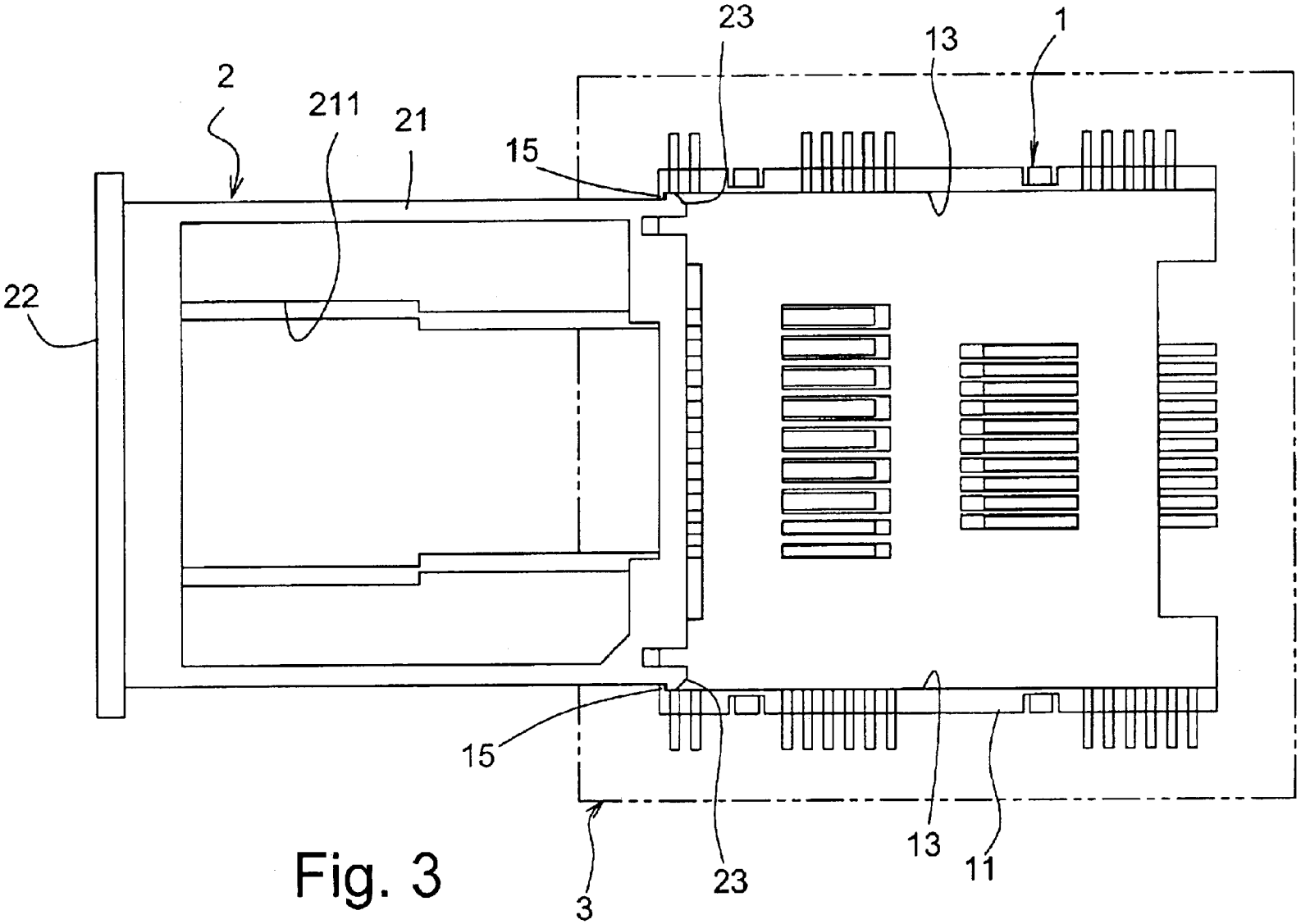
FIG. 3 is a plane view of the present invention, showing that the cartridge seat is drawn out from the seat body.
Figure 4:
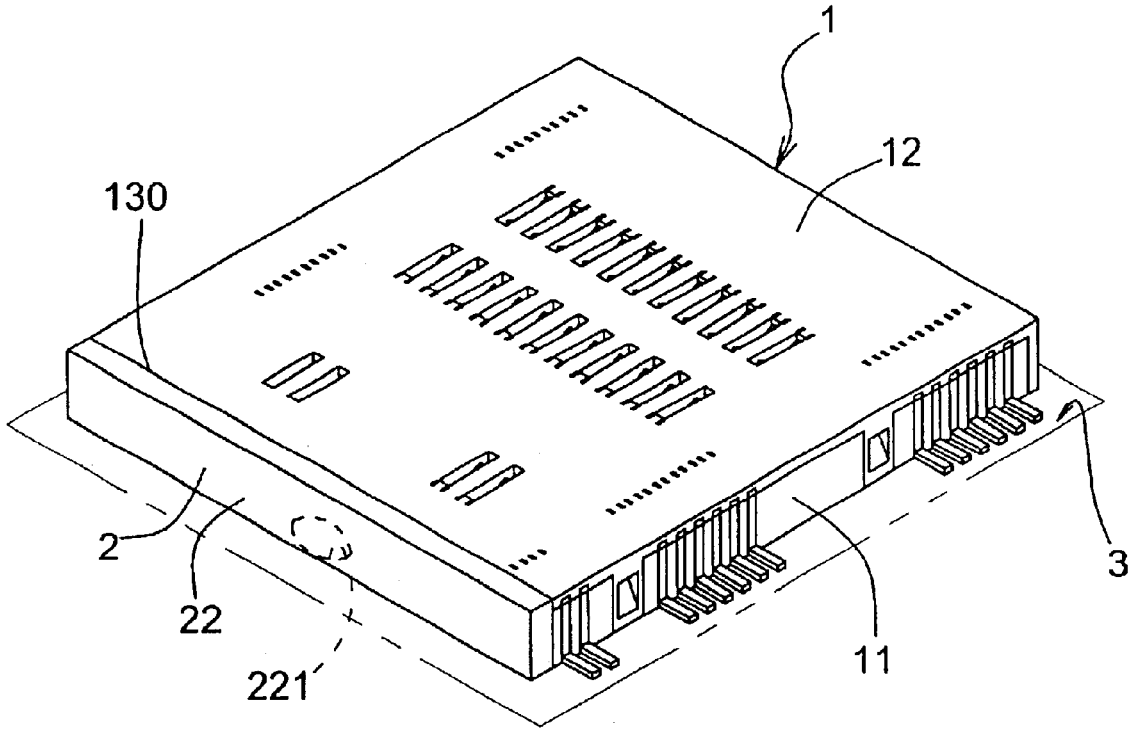
Figure 5:
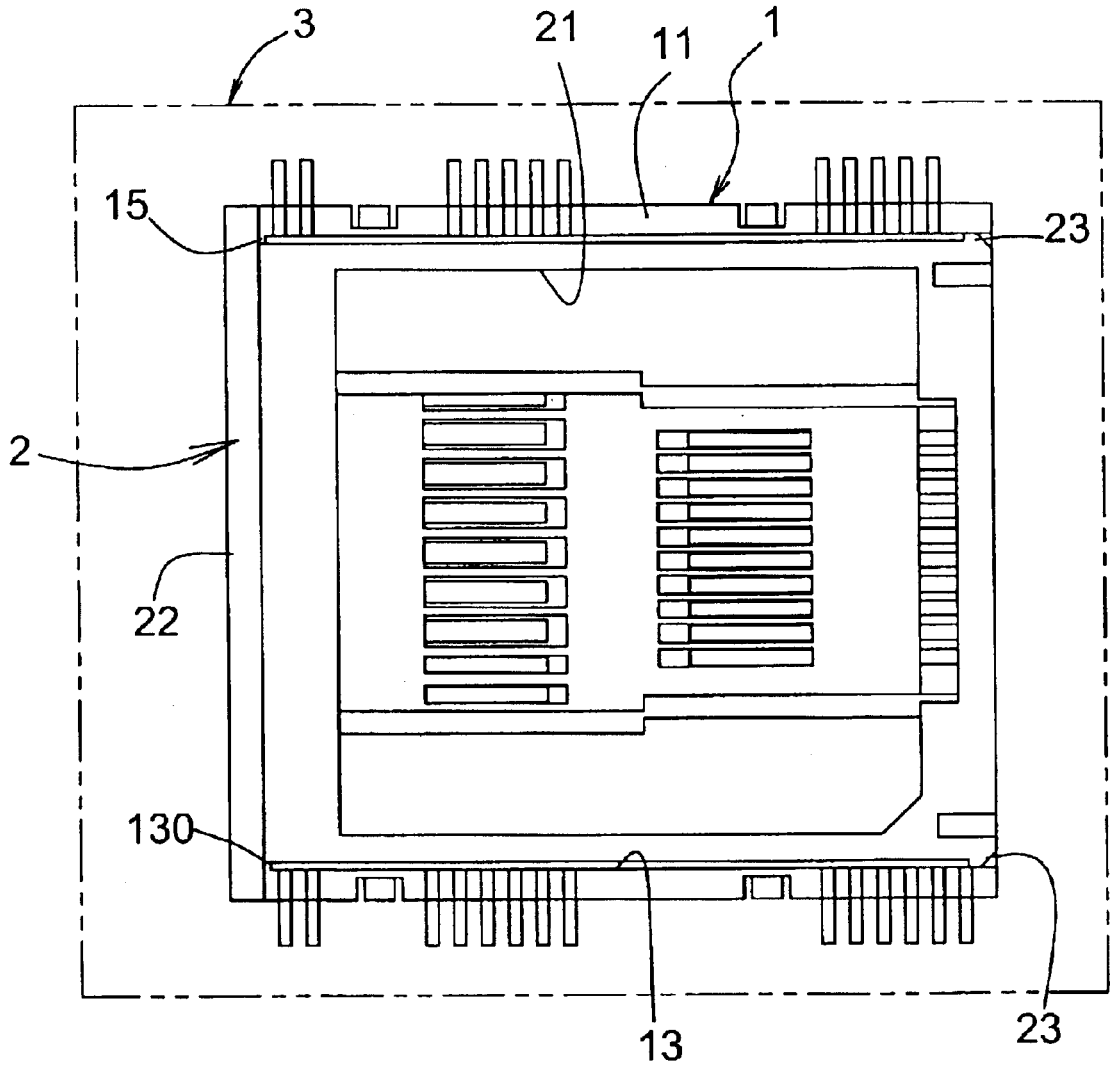
FIG. 5 is a plane view of the present invention according to FIG. 4, showing that the cartridge seat is pushed into the seat body.
Figure 6:
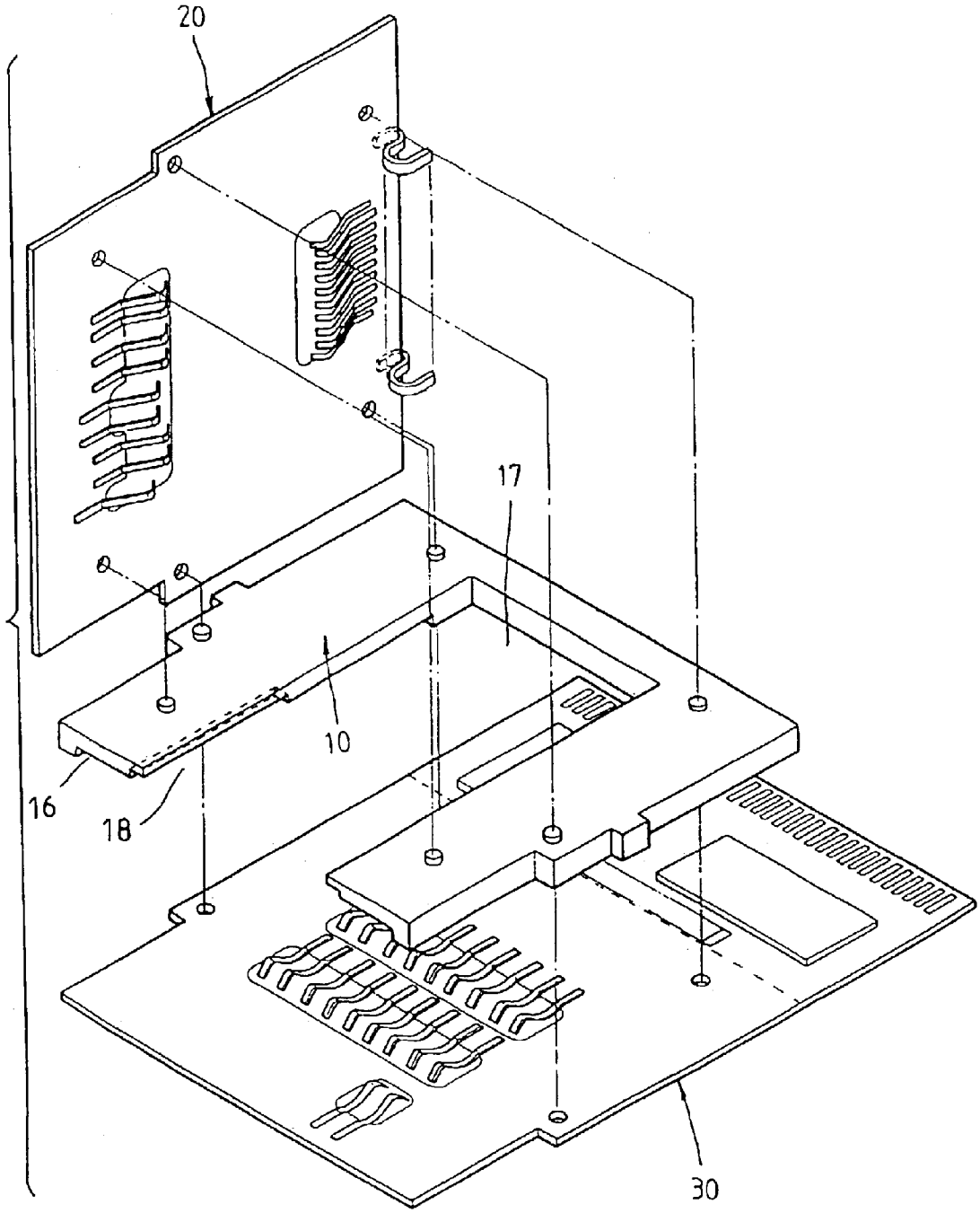
Fig. 6 PRIOR ART
FIG. 6 is a perspective exploded view of a conventional memory card connector.
Figure 7:
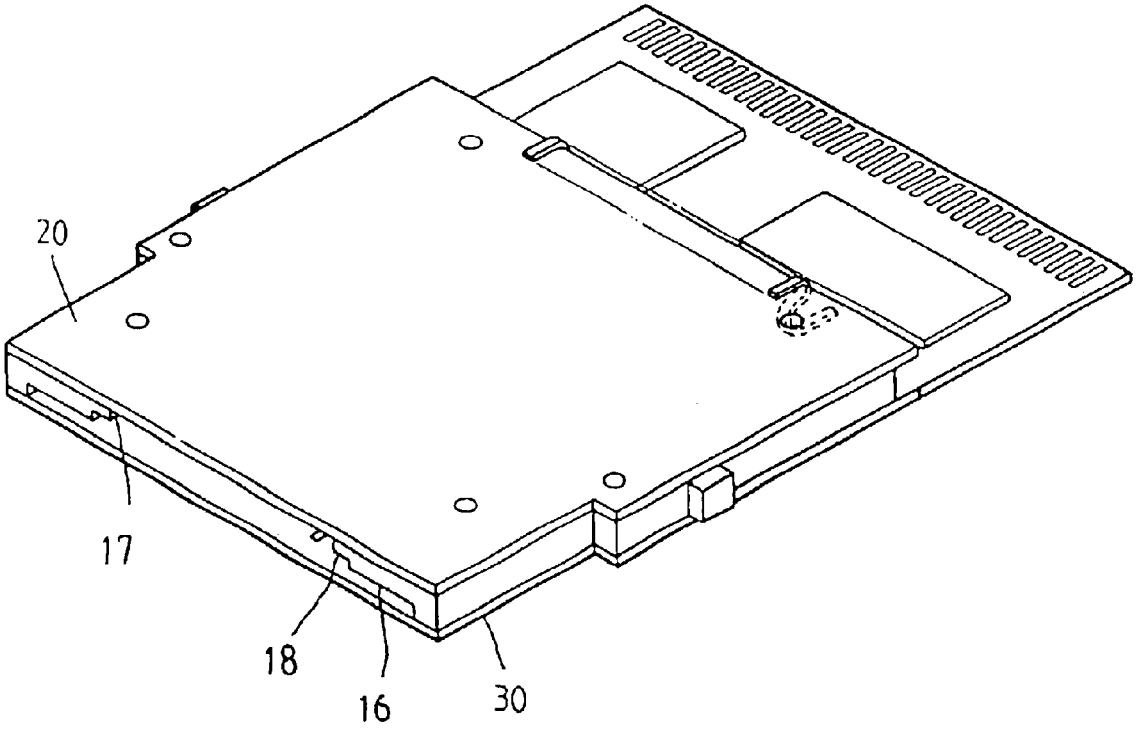
Fig. 7 PRIOR ART
FIG. 7 is a perspective assembled view of the conventional memory card connector.

Referring to FIG. 3, the rear side of the cartridge seat 2 has at least one locating section 23. When the cartridge seat 2 is outward drawn from the seat body 1, the locating section 23 correspondingly hooks a stop section 15 formed in the slide cavity 13 of the seat body 1 so as to stop the cartridge seat 2 from detaching out from the seat body 1.

The front board 22 can be integrally formed with the board body 21 of the cartridge seat 2. Alternatively, the front board 22 and the board body 21 can be separable members assembled with each other. The edge of the front board 22 is formed with a finger dent 221, whereby a user's finger can extend into the finger dent 221 to draw out the cartridge seat 2.

The memory card socket with drawer-type cartridge seat of the present invention can be mounted on a notebook-type computer, a personal computer mainframe, an output equipment, etc.

Referring to FIGS. 2 and 3, in use of the memory card socket with drawer-type cartridge seat of the present invention, a user can draw the cartridge seat 2 out from the seat body 1. Thereafter, a memory card is selectively laid into a suitable memory card chamber 211 of the cartridge seat 2. Then the cartridge seat 2 is pushed in to make the memory card electrically connect with the corresponding terminals 14 inside the seat body 1 for data transmission. After the board body 21 of the cartridge seat 2 is pushed into the seat body 1, the front board 22 blocks the entry 130 of the slide cavity of the seat body 1 so that external alien articles or dust is prevented from entering the seat body through the entry 130. Accordingly, the terminals 14 in the seat body 1 are kept clean and the quality of connection between the terminals 14 and the memory card is ensured.

The above embodiments are only used to illustrate the present invention, not intended to limit the scope thereof. Many modifications of the above embodiments can be made without departing from the spirit of the present invention.

What is claimed is:

1. A memory card socket with a drawer-type cartridge seat, comprising:

a seat body including a bottom board section and a top board section which define therebetween a slide cavity, multiple terminals being inlaid in the seat body; and a cartridge seat including a board body snugly and slidably placed in the slide cavity of the seat body, at least one memory card chamber being formed on the board body, the memory card chamber being defined between a pair of opposing front and rear walls and a pair of opposing side walls, a front board being connected with front edge of the board body, whereby when the board body is slidably placed in the seat body, the front board totally blocks an entry of the slide cavity of the seat body for preventing external alien articles or dust from entering the seat body through the entry, the memory card chamber having an open top for insert and removal of a memory card and an open bottom with at least one lower stop edge projecting from the opposing side walls for supporting a memory card thereon, whereby a memory card can be stably overlaid on and received in the memory chamber and the memory card can enter the seat body along with the cartridge seat to connect with corresponding terminals thereof, a rear side of the cartridge seat having a pair of locating sections, whereby when the cartridge seat is outwardly drawn from the seat body, the locating sections each hook to a corresponding stop section formed in the slide cavity of the seat body to stop the cartridge seat from detaching from the seat body.

2. The memory card socket with drawer-type cartridge seat as claimed in claim 1, wherein the seat body includes: a bottom board section overlaid on a circuit board, multiple terminals being inlaid in the bottom board section, one end of the terminal being soldered with a corresponding circuit of the circuit board; a top board section correspondingly overlaid on and latched with the bottom board section, multiple terminals being inlaid in the top board section; and multiple connecting terminals stably inlaid in the bottom board section, one end of the connecting terminal being soldered with a corresponding circuit of the circuit board, while the other end thereof projectively extending to lower side of a second end of the corresponding terminal of the top board section, whereby after the bottom board section and the top board section are mated with each other, the terminals of the top board section respectively correspondingly contact with the connecting terminals to electrically connect with the circuit of the circuit board.

3. The memory card socket with drawer-type cartridge seat as claimed in claim 1, wherein at least one side of the memory card chamber has an upper stop edge projecting therefrom for preventing the memory card from upward jumping and displacing.

4. The memory card socket with drawer-type cartridge seat as claimed in claim 1, wherein an edge of the front board of the cartridge seat is formed with a finger dent.

5. The memory card socket with drawer-type cartridge seat as claimed in claim 1, wherein the board body includes at least three memory card chambers formed therein in overlapping relationship, each of the three memory card chambers being of a different size to correspond to three different standard memory cards.

* * * * *